US005116191A

United States Patent [19]

Van

[11] Patent Number: 5,116,191

[45] Date of Patent: May 26, 1992

[54] METHOD AND ARTICLE FOR STACKING BOXES ON A PALLET BOARD

[76] Inventor: Eugene Van, 630 S. Oaks Ave., Ontario, Calif. 91762

[21] Appl. No.: 208,594

[22] Filed: Jun. 20, 1988

Related U.S. Application Data

[63] Continuation-in-part of Ser. No. 832,147, Feb. 24, 1986, abandoned.

[51] Int. Cl.[5] ..... B65D 13/00

[52] U.S. Cl. ..... 414/786; 410/155; 229/916; 414/930; 414/791.8; 414/789.5; 211/59.4

[58] Field of Search ..... 414/923, 791.8, 927, 414/789.5, 789.4, 791.9, 798.2, 788, 788.1, 902, 922, 930, 791.6, 792, 792.5; 211/59.4; 108/55.1, 55.3, 51.1; 206/386, 585, 593, 821, 814; 410/52, 95, 122, 123, 155; 229/916

[56] References Cited

U.S. PATENT DOCUMENTS

| | | | |
|---|---|---|---|
| 2,224,432 | 12/1940 | Hoak | 410/155 |
| 2,341,088 | 2/1944 | Ellis | 410/155 |
| 2,589,718 | 3/1952 | Martin | 410/155 |
| 2,608,165 | 8/1952 | Pierce | 410/155 |
| 2,733,672 | 3/1976 | Pierce | 410/155 |
| 2,760,444 | 8/1956 | Pierce | 410/155 |
| 3,073,431 | 1/1963 | Davis et al. | 414/930 X |
| 4,153,161 | 5/1979 | Taylor et al. | 206/386 |
| 4,165,806 | 8/1979 | Cayton | 108/55.1 X |

*Primary Examiner*—David A. Bucci
*Assistant Examiner*—James T. Eller, Jr.
*Attorney, Agent, or Firm*—Denton L. Anderson

[57] ABSTRACT

Provided is (i) a method for reinforcing pallet board loads having internal ventilation channels and (ii) a pallet board brace useful in such method. The method comprises:

(a) stacking each tier of the pallet board load in a preselected configuration such that the sides of the boxes on each tier form at least two open channels in fluid communication with one another, wherein at least one end of each channel is open to the exterior of the tier and wherein each channel is at least one inch wide; and (b) bracing the boxes to prevent them from shifting laterally into the open channels by interposing spacing elements between the boxes on opposites sides of the channels, the spacing elements being disposed in fixed relationship to one another by a suitable rigid structure.

12 Claims, 4 Drawing Sheets

METHOD AND ARTICLE FOR STACKING BOXES ON A PALLET BOARD

RELATED APPLICATION

This is a continuation-in-part of U.S. patent application Ser. No. 832,147 filed Feb. 24, 1986, abandoned.

BACKGROUND

The present invention is directed to a method for stacking boxes on a pallet board. The invention is also directed to a brace useful in such method.

The use of pallet boards as an aid in the shipping of packaged goods is common in all areas of national and international commerce. The great advantage of palletized goods is the ease with which they can be maneuvered about a warehouse and the efficiency with which they can be moved into and out of cargo transport carriers.

With certain cargo, it is highly advantageous to be able to circulate a gaseous mixture among the palletized boxes and/or to be able to exhaust gases away from the palletized boxes. For instance, where the cargo needs to be refrigerated, it is desirable to be able to circulate chilled air among the palletized boxes. Also, where the cargo consists of fruits or vegetables, it is frequently desirable to be able to circulate gaseous ripening agents and/or insecticides among the palletized boxes. Some fruits, such as green bananas, give off a gas while they are in transit. Such gas results from the tendency of the fruit to ripen in the box. The gas will tend to build up and create pressure. Such pressure tends to create heat which in turn tends to accelerate the riping process (and the consequent evolution of gas). Thus, if the gas is not exhausted from among the boxes, the fruit will ripen rapidly and unevenly. Much of the cargo may even overripen and spoil.

Attempts to provide circulation around palletized boxes have been less than totally successful. One such attempt consists of stacking the palletized cargo on a grating which is slightly elevated above a floor. Gases are allowed to flow below the lower-most pallets (those actually sitting upon the grating), but gases are not free to flow among the boxes or along the sides or above the palletized cargo. Other attempts utilize perforated floors, walls and/or ceilings capable of allowing the free flow of gas around the palletized cargo but not around the individual palletized loads nor around the individual boxes. Where the need for ventilation is critical, warehouses and shippers resort to constructing customized bulkheads or shelving within the cargo storage area to separate each palletized load and thereby facilitate the flow of gases around them. Such custom construction is very expensive and does nothing towards ventilating the boxes which are located on the interior of the palletized load.

There is therefore a need for a device and a method for storing palletized cargo which will provide ventilation for all of the palletized boxes.

There is a further need for a device and a method for storing palletized cargo in such a way that individual palletized loads are ventilated, which device and method is less expensive and faster to implement than the construction of customized bulkheads or shelving.

SUMMARY

The present invention satisfies these needs. The invention provides a method for stacking at least two horizontal tiers of uniformly shaped boxes on a pallet board so as to create at least two open channels within each of the tiers. The method comprises the steps of:

(a) stacking each tier of boxes on the pallet board in a preselected configuration such that the sides of the boxes on the tier form at least two open channels in fluid communication with one another, at least one end of each of the channels being open to the exterior of the tier, and each channel being at least about 1" wide; and (b) bracing the boxes to prevent them from shifting laterally into the open channels by interposing spacing elements between the boxes on opposite sides of the channels.

The spacing elements are disposed in fixed relationship to one another by a suitable rigid structural means.

DRAWINGS

These and other features, aspects and advantages of the present invention will become better understood with reference to the following description, appended claims and accompanying drawings where:

FIG. 13 is a side view and partial cross-section of the pallet load shown in FIG. 8; and FIG. 14 is a cross-sectional view of the pallet load shown in FIG. 13.

DESCRIPTION

Figure 1:
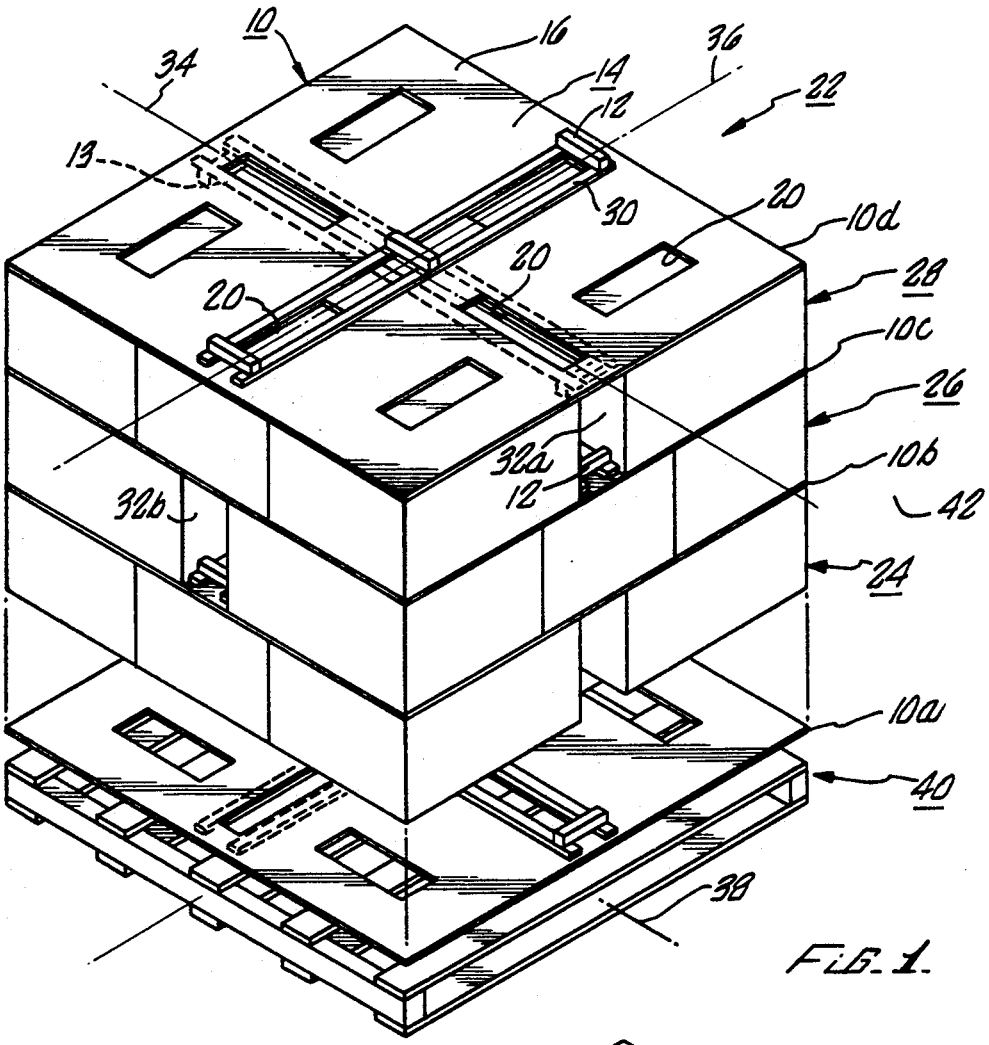
FIG. 1 is a perspective view of a first pallet load demonstrating features of the invention.

The invention comprises a method for stacking boxes upon a pallet board and a brace useful in such method. As used herein, the term "pallet board" means any portable surface upon which boxes can be stacked. Typically, pallet boards are wooden surfaces constructed by appending a plurality of parallel slats orthogonally between two parallel side members.

With reference to FIGS. 1, 2, 6 and 7, a brace 10 comprises a plurality of spacing elements (shown in the Drawings as spacer blocks 12) affixed to a flat sheet 14.

The flat sheet 14 has a top side 16 and a bottom side 18 and provides a support for the spacer blocks 12. Preferably, the flat sheet 14, is a rigid structure so that the spacer blocks 12 remain in spaced relation to each other. Also, it is preferable that the sheet 14 be thin, to minimize the space it occupies, lightweight to facilitate its handling, and inexpensive. Materials such as plywood, plastics and cardboard are acceptable, with cardboard being the most preferred because of its low cost. Optionally, the sheet 14 can be perforated with vent holes 20 to permit vapor communication between the top side 16 and the bottom side 18.

The sheet 14 has a surface area of sufficient size and shape to provide a support for each of the blocks 12. For ease of handling and field alignment during pallet load assembly, it is preferable that the surface area of the sheet 14 has approximately the same size and shape as the tier of boxes upon which it is disposed when in use.

In operation, braces 10 are interposed between all of the tiers of boxes in the pallet board load 22. For additional load stability, it is preferable that a brace 10 also be placed beneath the lower-most tier of boxes. FIG. 1 illustrates a pallet load 22 consisting of three tiers of boxes and four braces 10: a lower-most brace 10*a*, a lower-most tier of boxes 24, a lower-middle brace 10*b*, a middle tier of boxes 26, an upper-middle brace 10*c*, an upper-most tier of boxes 24, and an upper-most brace 10*d*.

The spacer blocks 12 are disposed on the sheet 14 so as to provide a means for maintaining the separation of the boxes on each tier. Spacer blocks 12 having a cylindrical shape can be used in the invention. (As used herein, the term "cylinder" is broadly defined as the solid or hollow surface generated by a straight line moving always parallel to itself and describing any fixed curve [not necessarily a circle]. A cylinder has a regular transverse cross-section which may be of any shape. A cylinder may be hollow or solid.) The cylindrically-shaped spacer blocks 12 are disposed so that each of their ends abuts a box in a pallet load tier. In this way, one cylindrically shaped spacer block 12 separates two boxes in a tier by a distance equal to the length of the spacer block 12. Preferably the cylindrically shaped spacer blocks 12 have at least one flat side to facilitate attachment to the sheet 14.

The spacer blocks 12 are sufficiently large to maintain their position between the segregated boxes. In general, the blocks must be at least about 0.25 inches thick and preferably greater than about 0.5 inches thick. Cylinders having a 1"×1" square cross-section can be used.

The spacer blocks 12 can be constructed with a variety of materials. Since the lateral forces applied to the pallet load 18 are typically small, the spacer blocks 12 can often be constructed of relatively light materials. Wooden blocks can be used. Styrofoam and other lightweight materials are preferable because of their light weight and low cost.

The spacer blocks 12 are affixed to the sheet 14 by conventional means. Cementing the blocks to the sheet 14 with a glue is the preferred method because of its ease of implementation and low cost.

Figure 2:
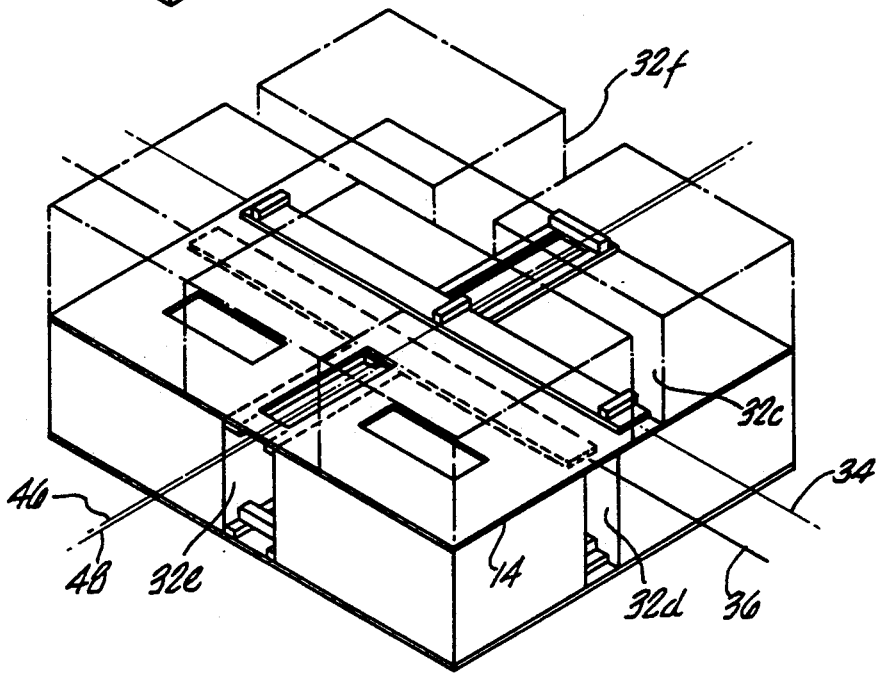
FIG. 2 is a perspective view of a second pallet load demonstrating features of the invention.

In an optional configuration illustrated in FIGS. 1 and 2, the spacer blocks 12 are affixed to a pair of parallel rails 30. The rails 30 can add rigidity to the spacer-sheet connection. For instance, where the spacer blocks 12 are wooden, they can be nailed to wooden rails 30 and the wooden rails 30 cemented to the sheet 14. The rails 30 also act as independent spacing means to maintain the segregation of the boxes.

The spacer blocks 12 are affixed to the sheet 14 so as to provide a means to segregate at least some of the boxes on each of the tiers on opposite sides of and adjacent to an open channel (shown in FIGS. 1, 2, 8, 13 and 14 as cylindrical void space 32) which is horizontally disposed within the tier. Brace 10*c* in FIG. 1, for instance, segregates the boxes on an upper tier of boxes (the upper-most tier 28), on opposite sides of a cylindrical first void space 32*a* and segregates the boxes on a lower tier of boxes (the middle tier 26) on opposite sides of a cylindrical second void space 32*b*. Where the boxes have a rectangular cross-section, the cylindrical void spaces 32 have a rectangular cross-section.

A first group of spacer blocks 12 are affixed to the underside 18 of the sheet 14 such that the midpoint of each block 12 is aligned along a first straight line 34. Each block is disposed perpendicular to the first line 34. A second group of spacer blocks 12 are affixed to the top side 16 of the sheet 14 such that the midpoint of each block 12 is aligned along a second straight line 36.

In a first embodiment illustrated in FIG. 1, the first line 34 is perpendicular to the second line 36 so that the first line 34 may be disposed in the same vertical plane as the longitudinal axis 38 of the pallet board 40 while the second line 36 can be disposed in the same vertical plane as the lateral axis 42 of the pallet board 40. In the first embodiment illustrated in FIG. 1, the configuration of the first straight line 34 facilitates the segregating of boxes on either side of the void space 32*a*, whose longitudinal axis is disposed in the same vertical plane as the longitudinal axis 38 of the pallet board 40. Also in the first embodiment illustrated in FIG. 1, the configuration facilitates the segregating of boxes on either side of a void space in the tier above brace 10*d* (not shown), whose longitudinal axis is disposed in the same vertical plane as the lateral axis 42 of the pallet board 40. The longitudinal axis of the void space in the tier above the brace 10*d* is preferably perpendicular to the longitudinal axis of the void space 32*a* to facilitate the cross-stacking of boxes in the pallet load 22.

The first embodiment illustrated in FIG. 1 is ideally configured to cross-stack six substantially uniformly shaped boxes per tier, three boxes per tier on either side of the cylindrical void space 32. The boxes on each side of the cylindrical void space 32 abut each other along one side and abut the cylindrical void space 32 at one end. For convenience, the pallet board 40 can be square and can be selected with the length of a side equal to three times the width of each box and with the length of the side being greater than twice the length of each box. When the pallet board 40 is so selected, the spacer blocks 12 are of uniform length x which is equal to the length of the pallet board 40 less twice the length of one of the boxes. This configuration allows a pallet load 22 with a square cross-section to be assembled on the pallet board 40, has a perimeter coincident with the perimeter of the pallet board 40, and has horizontal, cylindrical void spaces 32 each of which has a rectangular cross-section with a horizontal width x. The value x is preferably between about 4 and 7 inches to maximize pallet load rigidity which providing adequate ventilation along one end of each of the boxes. The first embodiment illustrated in FIG. 1 facilitates the building of pallet loads 22 which have several cylindrical void spaces 32, each at a predetermined elevation. This configuration allows the user to stack pallet loads 22 in his cargo storage facility such that each of the cylindrical avoid spaces 32 abut one another, thereby linking together to form a continuous ventilation channel throughout the entire cargo storage facility. The totality of these continuous channels facilitates the efficient influx and outflux of gases among each and every box in the cargo storage facility.

In the second embodiment illustrated in FIG. 2, the first line 34 is parallel to the second line 36. The second embodiment illustrated in FIG. 2 further comprises a third line 46 and a fourth line 48. The third line 46 is disposed in the same horizontal plane as the first line 34 and is perpendicular to the first line 34 so that the third line 46 can be disposed in the same vertical plane as the lateral axis 42 of the pallet board 40. The fourth line 48 is disposed in the same plane as the second line 36 and is perpendicular to the second line 36 so that the fourth line 48 can be disposed in the same vertical plan as the lateral axis 42 of the pallet board 40. In the second embodiment illustrated in FIG. 2, the configuration of the first straight line 34 facilitates the segregating of boxes on either side of an upper longitudinal void space 32*c* disposed above the sheet 14. Also in the second embodiment illustrated in FIG. 2, the configuration facilitates the segregating of boxes on either side of a longitudinal lower void space 32*d* disposed below the sheet 14. Further, the configuration illustrated in FIG. 2 facilitates the segregating of boxes on either side of a lower transverse void space 32*e* which is disposed horizontally below the sheet 14 perpendicular to the longitudinal lower void space 32*d* and extending from the longitudinal lower void space 32*d* to the side of the sheet 14 which is parallel with and closest to the second straight line 36. Finally, the configuration illustrated in FIG. 2 facilitates the segregating of boxes on either side of an upper transverse void space 32*f* which is disposed horizontally above the sheet 14 perpendicular to the upper longitudinal void space 32*c* and extending from the upper longitudinal void space 32*c* to the side of the sheet 14 which is parallel with and closest to the fist straight line 34.

The second embodiment illustrated in FIG. 2 is ideally configured to cross-stack five substantially uniformly shaped boxes per tier. Three of the boxes are aligned side by side with one end abutting the longitudinal void space. The other two boxes are disposed on the opposite side of the longitudinal void space with a side abutting the longitudinal void space and with opposing interior ends strattling the lateral void space. Preferably, to maximize pallet load rigidity while providing adequate ventilation, the width of the longitudinal void space is between about 1 and 3 inches and the width of the lateral void space is between about 4 and 6 inches. For uniformity, it is preferable that the width of the upper longitudinal void space 32*c* is substantially the same as the width of the lower longitudinal void space 32*d*, and that the width of the lower transverse void space 32*e* is substantially the same as the width of the upper transverse void space 32*f*.

Figure 3:
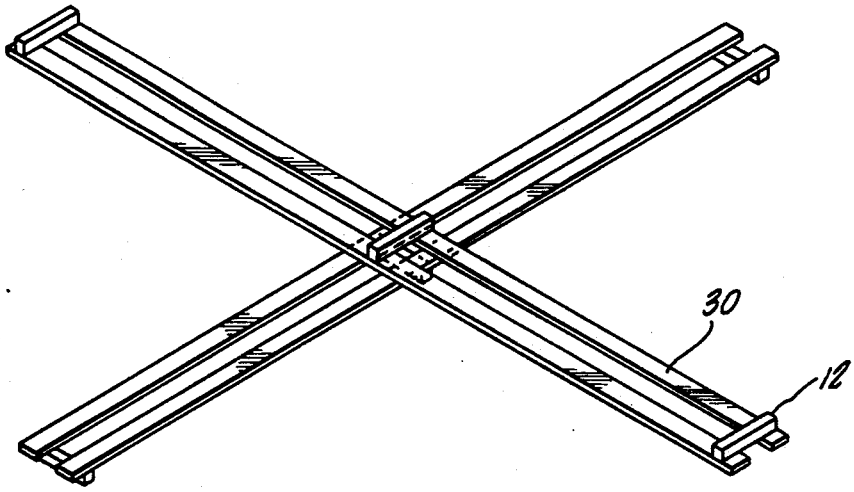
FIG. 3 is a perspective view of a first pallet load brace useful in the invention.
Figure 4:
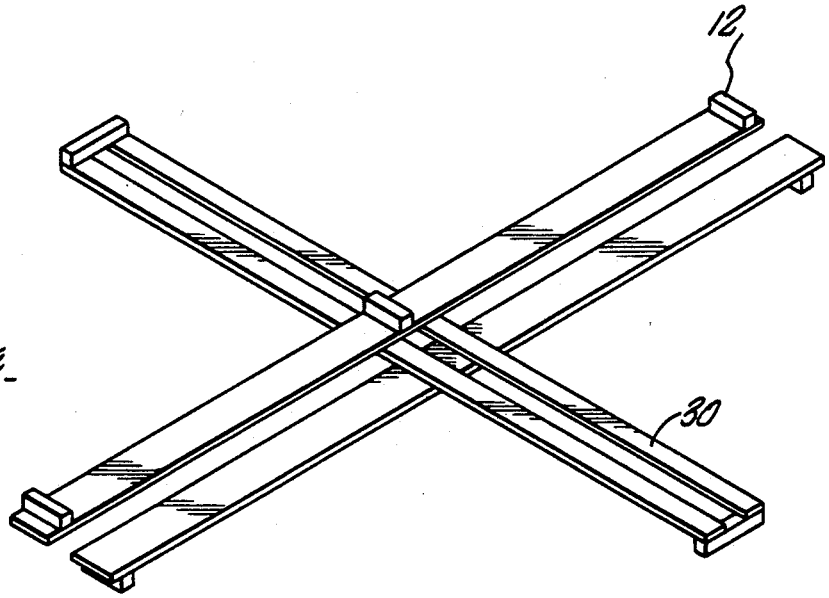
FIG. 4 is a perspective view of a second pallet load brace useful in the invention.
Figure 5:
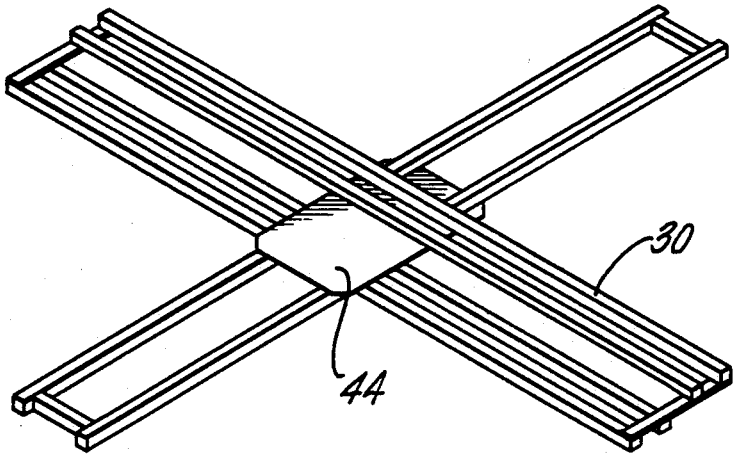
FIG. 5 is a perspective view of a third pallet load brace useful in the invention.

FIGS. 3, 4 and 5 illustrate embodiments of the invention wherein the spacer blocks 12 are supported by rails 30 instead of a flat sheet 14. The rails 30 may be constructed of any suitable support material. Wood, plastics and stiff cardboard are suitable, with wood being preferred be cause of its rigidity, light weight and low expense. 1.5"×0.25" slats have been found to be suitable for most conventional pallet loads such as those having a horizontal cross-sectional area of about 2,000 sq. inc. Preferably, the rails 30 are rigid so as to maintain the spacer blocks 12 in spaced relation to the one another.

FIG. 3 illustrates an embodiment of the invention having a spacer block 12 arrangement similar to that used in the embodiment illustrated in FIG. 1. The embodiment illustrated in FIG. 3 is used in substantially the same way as the embodiment illustrated in FIG. 1. FIG. 4 illustrates an embodiment having a spacer block 12 arrangement similar to that used in the embodiment illustrated in FIG. 2. The embodiment illustrated in FIG. 4 is used in substantially the same way as the embodiment illustrated in FIG. 2.

FIG. 5 illustrates an embodiment of the invention wherein the rails 30 provide the sole means for separating the boxes on each pallet tier. In this embodiment, the rails 30 are sufficiently thick to maintain each box in place. 1"×1" wooden members can be used to construct rails 30 suitable for most conventional pallet loads such as those having a horizontal cross-sectional area of about 2000 sq. in. In the embodiment illustrated in FIG. 5 an optional thin plate 44 is used to add additional strength to the brace 10. FIG. 5 is analogous to and is used in substantially the same way as the embodiment illustrated in FIG. 2.

Figure 9:
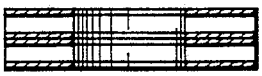
FIG. 9 is a perspective view of a sixth pallet load brace useful in the invention.
Figure 10:
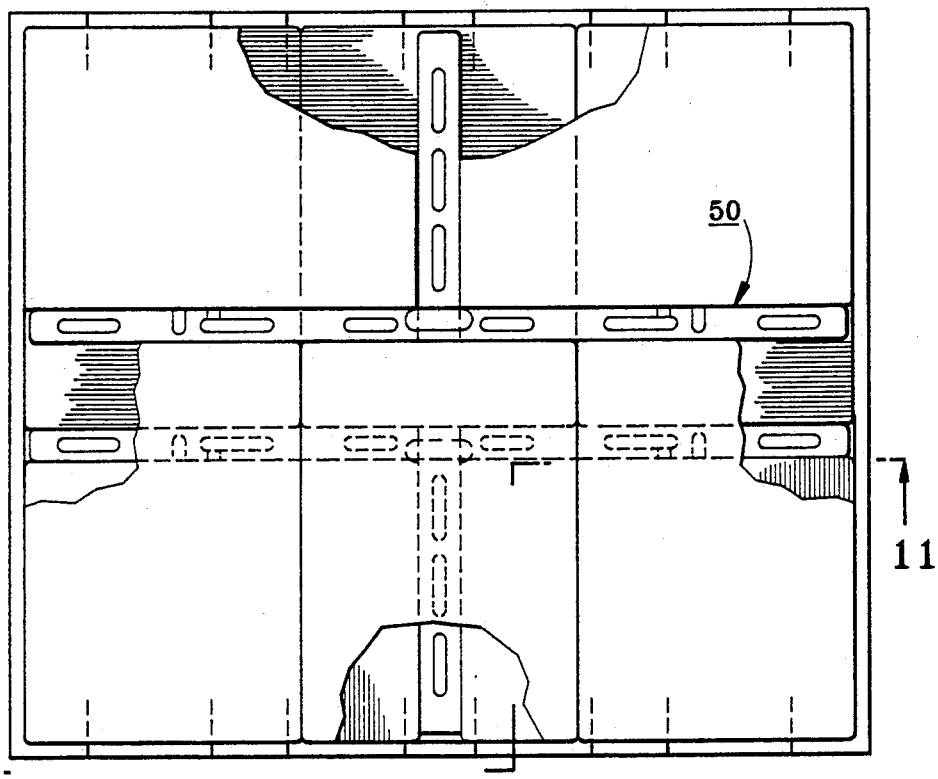
FIG. 10 is a cross-sectional view of one arm of the pallet load brace shown in FIG. 9.
Figure 11:
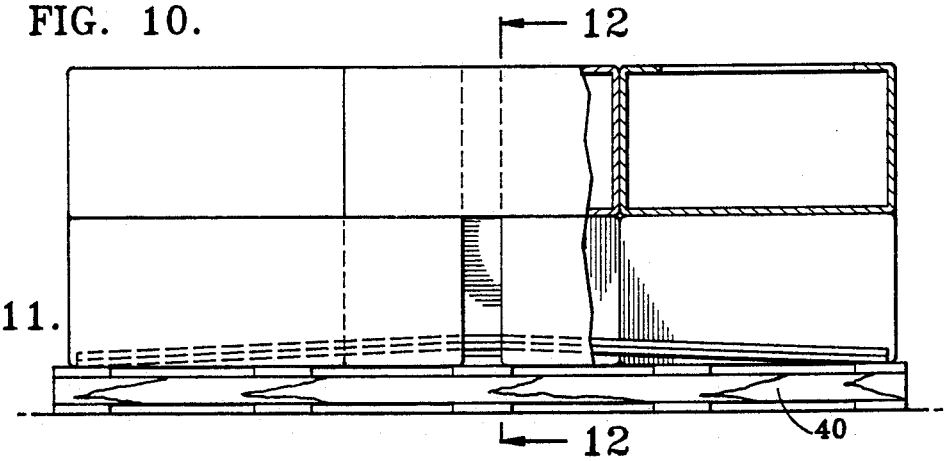
FIG. 11 is a cross-sectional view of the second arm of the pallet load brace shown in FIG. 9.
Figure 12:
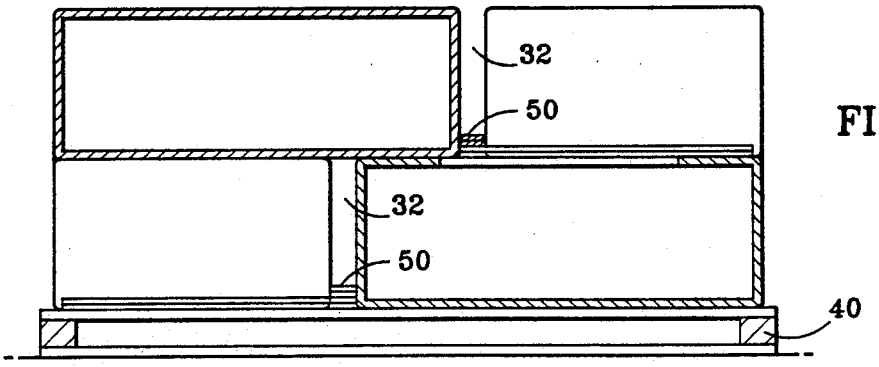
FIG. 12 is a top view of the pallet load shown in FIG. 8.

FIGS. 8, 12, 13 and 14 illustrate a method for stacking tiers of uniformly shaped boxes on a pallet board using a T-shaped pallet board brace 50. The T-shaped pallet board brace 50 is illustrated in FIGS. 9, 10 and 11.

The T-shaped pallet board brace 50 comprises a short, stem arm spacing element 52, one end of which is affixed at the midpoint of, and perpendicular to, a long, cross-arm spacing element 54.

The boxes, T-shaped pallet board brace 50 and/or pallet board 40 are configured so that the width of the pallet board 40 has approximately the same linear dimension as the sum of (i) the length 56 of one of the boxes, (ii) the width 58 of one of the boxes, and (iii) the width 59 of the long, cross-arm 54 of the T-shaped pallet board brace 50. The boxes, T-shaped pallet board brace 50, and/or pallet board 40 are also configured such that the length 60 of the pallet board 40 has approximately the same linear dimension as the sum of (i) twice the length 56 of one of the boxes plus (ii) the width 62 of the short, stem arm 52 of the T-shaped pallet board brace 50.

Each tier is disposed in a preselected configuration with three of the five boxes in the tier set side by side such that their respective ends are aligned with the length 60 of the pallet board 40. The other two boxes in the tier are disposed end to end such that a side of each box is aligned with the opposite side of the pallet board 40. The ends of the two boxes facing each other are spaced apart by a distance approximately equal to the width 62 of the short, stem arm 52 of the T-shaped pallet board brace 50. As disposed in this preselected configuration, the ends of the first three boxes are spaced apart from the sides of the remaining two boxes by a distance approximately equal to the width 59 of the long, cross-arm 54 of the T-shaped pallet board brace 50.

The T-shaped pallet board brace 50 is interposed within the two open channels 32 formed by the preselected configuration of the five boxes, to prevent the boxes from shifting laterally into the opened channels 32.

The T-shaped pallet load brace 50 may be composed of any suitable material such as wood, metal, plastic, styrofoam, etc. A highly desirable material is corrugated cardboard because of its inexpensiveness.

Each arm of the T-shaped pallet load brace 50 shown in FIGS. 9, 10 and 11 is comprised of two layers of corrugated cardboard affixed firmly together, such as with glue. Cutouts 64 and notches 66 can be made in each of the arms to minimize material and weight.

Each arm need be only as thick as necessary to mechanically block the boxes on each tier from shifting laterally into the open channels 32. Generally the thickness must be greater than about ⅛". Thicknesses of ¼" and greater are preferred.

EXAMPLE

Figure 6:
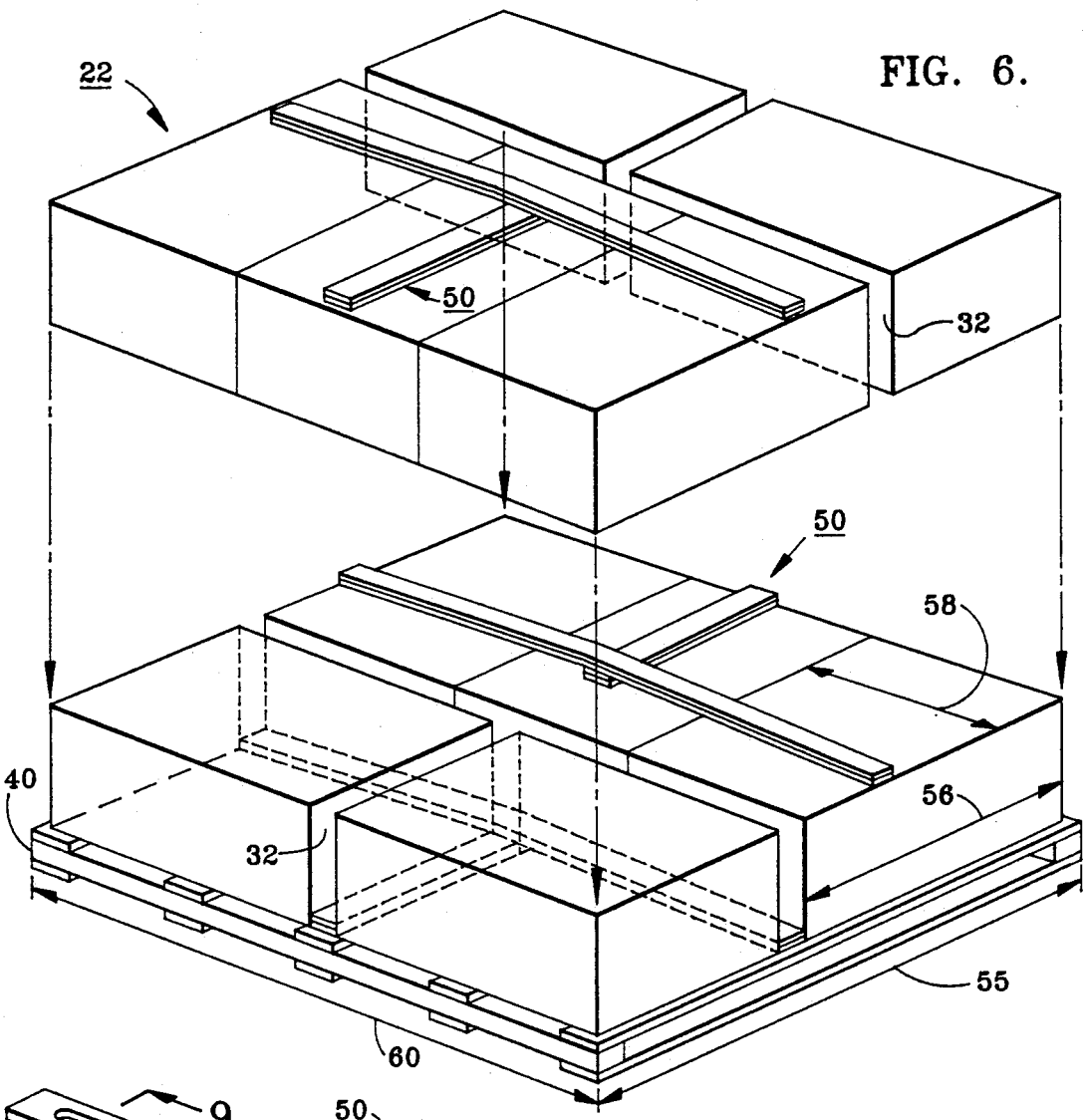
FIG. 6 is a top view of a fourth pallet load brace useful in the invention.
Figure 7:
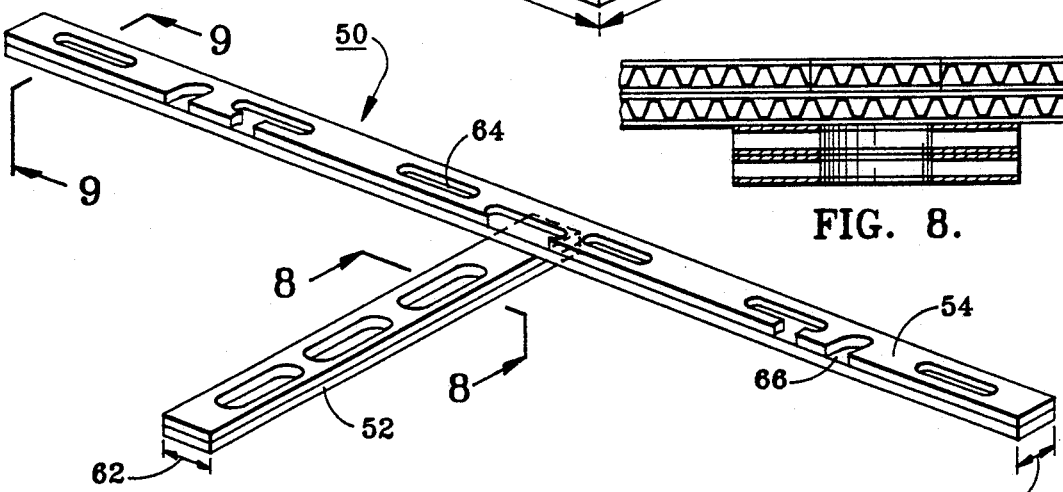
FIG. 7 is a top view of a fifth pallet load brace useful in the invention.
Figure 8:
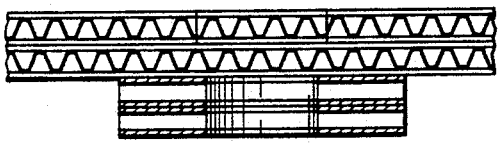
FIG. 8 is a perspective view of a third pallet load demonstrating features of the invention.

FIG. 6 illustrates a first example of a brace embodying features of the invention. FIG. 7 illustrates a second example of a brace embodying features of the invention. In both examples, the sheet 14 is constructed of cardboard and the spacer blocks 12 are constructed of wooden cylinders having a 1"×1" square cross-section.

Both examples are suitable for use in palletizing boxes having a parallelepiped shape with top and bottom dimensions of about 15"×20½", side dimensions of about 9"×20½", end dimensions of about 9"×15", and having an approximately 9"×3½" rectangular opening disposed length-wise in the center of the top and the bottom. Such boxes are commonly used on the West Coast for transporting green bananas.

The first example illustrated in FIG. 6 can be used to cross-stack six boxes per tier in the same way as the embodiment illustrated in FIG. 1. The configuration of the first example allows for lateral ventilation across the interior each of each box along channels created by the spacer blocks 12. It also allows for vertical ventilation up through the center of each box via the vent holes 20. The second example illustrated in FIG. 7 can be used to cross-stack five boxes per tier in the same way as the embodiment illustrated in FIG. 2. The configuration of the second example allows for lateral ventilation across the interior ends and/or sides of each box along channels created by the spacer blocks 12. It also allows for vertical ventilation up through the center of each box via the vent holes 20.

The present invention provides an inexpensive and easily employed brace for stacking boxes on a pallet board in a fixed configuration wherein vapor channels are created within the palletized cargo to allow for the free flow of gas to and/or from each box. The invention is especially useful in stacking cargo boxes containing perishable items in need of refrigeration and in stacking cargo boxes containing fruit such as bananas which give off a gas which must be exhausted from the cargo during transit.

Although the present invention has been described in considerable detail with reference to certain preferred versions, other versions are possible. For instance, the spacer blocks 12 need not be cylindrically shaped. Nodes of any shape can be used as they are capable of maintaining the separation between boxes on each tier. Therefore the spirit and scope of the appended claims should not necessarily be limited to the description of the preferred versions contained herein.

What is claimed is:

1. A method of storing a plurality of uniformly shaped boxes, wherein each box has a horizontal base, vertical sides and a horizontal top, the method comprising the steps of:

(a) cross-stacking the boxes in horizontal tiers on a plurality of pallet boards to define a plurality of pallet board loads, each pallet board load having a plurality of tiers formed in a cross-stacked relationship to adjacent tiers, each pallet board load having four vertical sides, an exterior and an interior, the boxes being stacked on each pallet board such that at least one ventilated tier is defined in each pallet board load by arranging the boxes on the ventilated tier to define a horizontal interior ventilation channel, the ventilation channel defining a first pallet board load opening in a first vertical side of the pallet board load and a second pallet board load opening in a second side of the pallet board load;

(b) bracing the boxes in each ventilated tier by interposing spacing elements between the boxes located on opposite sides of the ventilation channel, the spacing elements being predisposed in fixed relationship to one another by rigid structural means so as to conform to the outline of part of the ventilation channel while leaving open the balance of the ventilation channel for ventilation purposes, and thereby prevent the boxes from shifting laterally into the ventilation channel; and (c) arranging the pallet board loads in close proximity to one another in such a way that the pallet board load openings of adjacent pallet board loads are in alignment with one another and a ventilation channel in each pallet board load communicates with a ventilation channel of at least one other pallet board load.

2. The method of claim 1 wherein the spacing elements and structural means comprise a plurality of arms affixed together.

3. The method of claim 2 wherein the spacing elements and structural means comprise a stem arm, one end of which is affixed to and perpendicular with, a cross-arm.

4. The method of claim 2 wherein the arms are greater than about one inch in width.

5. The method of claim 1 wherein the open channels are greater than about one inch in width.

6. The method of claim 1 wherein the spacing elements are a plurality of blocks.

7. The method of claim 6 wherein the structural means comprise a sheet of material having approximately the same length and width as that of the pallet board.

8. The method of claim 6 wherein the structural means comprise rails.

9. The method of claim 6 wherein the blocks are between about 4 and about 7 inches long.

10. The method of claim 6 wherein the blocks are at least 0.25 inches thick.

11. The method of claim 1 wherein the number of boxes on each tier is 6.

12. The method of claim 1 wherein the number of boxes on each tier is 5.

* * * * *